United States Patent [19]

Schechter

[11] 4,300,509

[45] Nov. 17, 1981

[54] FUEL INJECTION AND CONTROL SYSTEMS

[75] Inventor: Michael M. Schechter, Southfield, Mich.

[73] Assignee: Ford Motor Company, Dearborn, Mich.

[21] Appl. No.: 193,984

[22] Filed: Oct. 6, 1980

[51] Int. Cl.[3] ..... F02B 3/00

[52] U.S. Cl. ..... 123/499; 123/504; 123/456

[58] Field of Search ..... 123/472, 455, 458, 459, 123/456, 497, 498, 499

[56] References Cited

U.S. PATENT DOCUMENTS

| | | | |
|---|---|---|---|
| 3,067,581 | 12/1962 | Reggio | 123/459 |
| 3,501,099 | 3/1970 | Benson | 123/472 |
| 3,516,395 | 6/1970 | Bassot | 123/472 |
| 3,592,177 | 7/1971 | Wehde | 123/456 |
| 3,625,192 | 12/1971 | Dreisin | 123/139 E |
| 3,837,234 | 9/1974 | Links | 123/139 E |
| 3,919,989 | 11/1975 | Jarrett | 123/472 |
| 3,990,413 | 11/1976 | Pischinger | 123/139 E |
| 4,044,745 | 8/1977 | Brinkman | 123/139 E |
| 4,221,192 | 9/1980 | Badgley | 123/456 |

*Primary Examiner*—Ronald B. Cox
*Attorney, Agent, or Firm*—Robert E. McCollum; Clifford L. Sadler

[57] ABSTRACT

An automotive type fuel injection control and system including a number of unit fuel injector assemblies, one for each cylinder of the engine, supplied with an excess of fuel, the pressure of the fuel in the return line being used to vary the stroke of each unit injector pumping element, the pressure of the return fuel being controlled by a solenoid controlled pressure regulator operated in response to changing engine operating conditions by vary the stroke to vary the fuel discharged from the injectors.

9 Claims, 6 Drawing Figures

FUEL INJECTION AND CONTROL SYSTEMS

This invention relates in general to an automotive type fuel injection system and controls. Although it has universal application to all fuel injection systems, it is particularly suitable for torch type ignition systems in which a minute amount of fuel is injected into a precombustion chamber and ignited with precise timing to form a small pilot flame that ignites the leaner main charge in the main combustion chamber. The fuel injection system in particular includes a set of unit injector assemblies that comprise afuel injector integrated with a plunger type fuel pump, a solenoid actuator, and a mechanical stroke control mechanism for varying the volume of fuel pumped. The stroke control mechanism is variably movable in response to changes in the return fuel pressure, i.e., of the fuel vented or returned to the fuel supply system inlet.

It is, therefore, a primary object of the invention to provide a fuel injection control and system that utilizes a unit injector assembly with a variable pump plunger stroke mechanism controlled by the pressure of the fuel being returned to the pump, the return fuel being controlled in pressure level in accordance with the operating conditions of the engine to provide the proper volume of fuel injection through each of the nozzles.

Fuel injection systems of this general type in the prior art fail to provide the compact, electrically energized unit injector assemblies of the type of this invention. For example, U.S. Pat. No. 3,990,413, Pischinger, shows a plunger type pumping assembly with a delivery valve and a stroke control for varying the plunger stroke; however, these elements are not integrated into a single unit, there is no electromagnetic means for actuating the plunger, nor is the stroke control operated by the pressure level of the return fuel.

U.S. Pat. No. 3,625,192 shows a fuel injection system in which fuel is pressurized behind a metering plunger 12 to determine the length of time the plunger remains open. However, the stroke control is not controlled by fuel pressure and the plunger 12 operates more like a needle valve than a pumping plunger.

U.S. Pat. No. 3,837,324, Links, shows an integrated fuel injection assembly having a pump and nozzle assembly integrated, and solenoid means for controlling a fuel valve. However, the stroke control mechanism is not varied by varying fluid return pressure.

U.S. Pat. No. 4,044,745, Brinkman, shows an oscillating pump and an electromagnet, with stroke control means, but not constructed in the manner of this invention. The pump has an entirely different activating mechanism and the stroke control is not varied by return fuel pressure.

It is another object of the invention, therefore, to provide a fuel injection control and system for an automotive type internal combustion engine that includes a number of unit injector assemblies each of which contains a fuel injector integrated with a radial type pumping plunger operated by a solenoid and having a stroke means that is varied in accordance with a variable fuel return pressure that is electrically controlled to vary in response to different operating conditions of the engine to vary the volume of fuel injected.

Other objects, features, and advantages of the invention will become more apparent upon reference to the succeeding detailed description thereof, and to the drawings illustrating the preferred embodiments thereof; wherein:

FIG. 1 schematically illustrates a fuel injection and control system embodying the invention;

Figure 1:
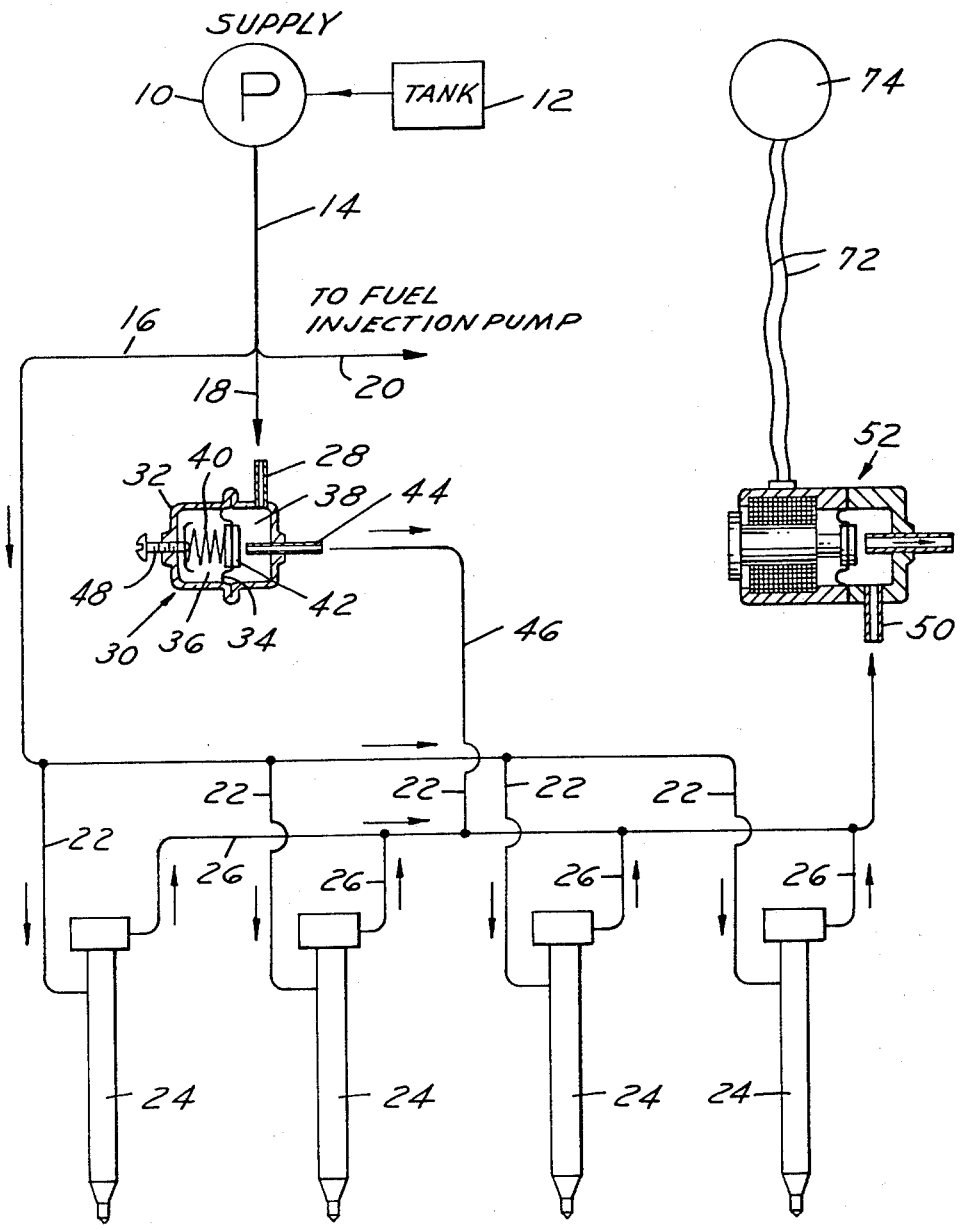
Figure 2:
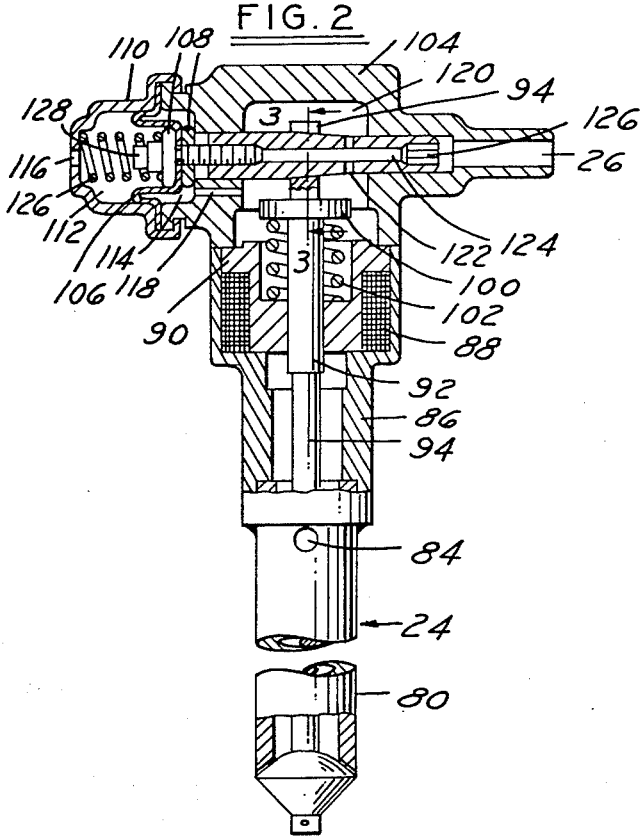
FIG. 2 is an enlarged cross-sectional view of one of the unit fuel injectors shown in FIG. 1.
Figure 3:
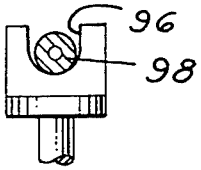
FIG. 3 is a cross-sectional view taken on a plane indicated by and viewed in the direction of the arrows III—III of FIG. 2.

The fuel injection system shown in FIG. 1 includes a main fuel supply pump 10 that draws fuel from a tank or reservoir 12 and delivers the same at a low pressure into a fuel supply line 14. Supply line 14 has three branches 16, 18 and 20. The line 16 supplies fuel continuously through four sub-branch lines 22 to four unit fuel injector assemblies 24. As will be described later, and as seen in FIGS. 2 and 3, each of the unit injector assemblies 24 includes a fuel injector, a plunger type pumping unit, a solenoid for actuating the plunger, and a stroke control means actuated by the level of the fuel pressure in a return line 26 connected to each of the unit injector assemblies, as shown.

The fuel supply branch line 20 is, as indicated, adapted to be connected to the main fuel injection pump of the system to supply fuel continuously thereto in an amount in excess of that required by the pump. As stated previously, this fuel injection system is particularly suitable for a prechamber type engine construction for supplying a small controlled amount of fuel to the prechamber through the unit injector assemblies 24.

Fuel supply branch line 18 is shown as connected to the inlet 28 of a first fixed level pressure regulator 30. The purpose of this regulator 30 is to assure an adequate and constant supply fuel pressure to the unit injectors that is always higher than the fuel pressure in the return lines 26. In this case, the pressure regulator 30 consists of a casing 32 partitioned by an annular flexible diaphragm 34 into an atmospheric pressure chamber 36 and a fuel pressure chamber 38. A spring 40 normally biases a disc-type valve 42 towards the end of a stand pipe 44 to throttle communication of fuel from branch supply line 18 to a discharger line 46 connected to the fuel return lines 26. An adjustable screw mechanism 48 is provided for fixing the preload on spring 40 to thereby set the pressure in supply line 28 at a constant valve equal to the force of the spring 40. Any higher pressure will move the disc valve 42 leftwardly to uncover stand pipe 44 more and vent more of the fuel into return line 46 until the set pressure level is regained.

Figure 4:
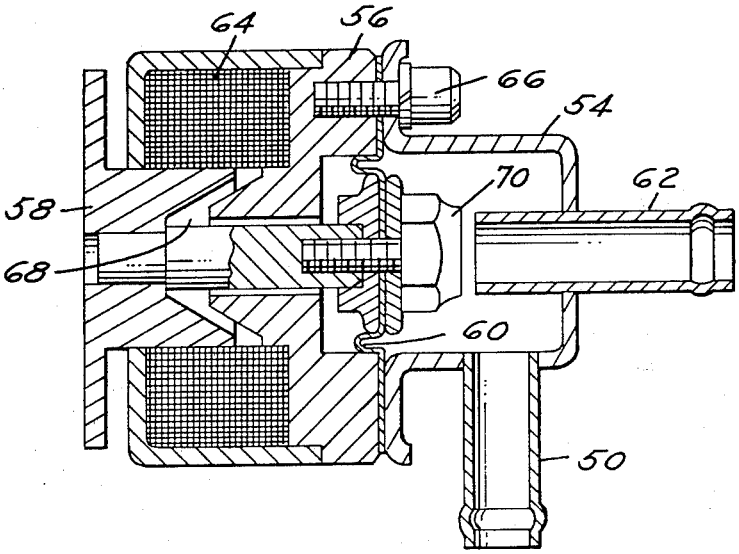
FIG. 4 is an enlarged cross-sectional view of the pressure regulator mechanism shown in FIG. 1.

Each of the return lines 26 from the injector unit assemblies 24 is connected to the inlet 50 of a second variable pressure regulator unit 52 shown more clearly in FIG. 4. This particular pressure regulator is controlled by a solenoid coil energizable in accordance with changing engine operating conditions. More particularly, pressure regulator 52 consists essentially of a three-piece assembly that includes a fuel chamber defining housing 54, the stationary core 56 of a solenoid assembly, and the moveable combination armature-valve mechanism 58 of the solenoid.

Hollow housing 54 is bolted to the annular stationary core 56 of the solenoid with the edges of an annular flexible diaphragm 60 secured therebetween. The housing contains an opening through which is inserted a stand pipe 62 constituting a fuel outlet that is adapted to be connected to tank 12 shown in FIG. 1 to return fuel thereto leaking past the elements of the unit fuel injector assemblies 24 and vented from the pressure regulator device 30. The stationary core 56 in this case is secured to a solenoid coil 64 that surrounds the core and the movable armature 58. An adjustable screw mechanism 66 is provided for adjusting the conventional gap 68 between the moveable and stationary parts of the solenoid, in a known manner. A valve element or piston 70 is shown screwed to the armature 58 of the solenoid through a hole in the annular diaphragm 60. Suitable wiring 72 (FIG. 1) connects the solenoid coil 64 to a sensor unit 74 operably selectively connected to various parts of the internal combustion engine on which the injection system is installed.

In this case, the unit 74 could be a microprocessor unit receiving signals from various portions of the engine with respect to temperature, speed, pressure, etc. for converting the same into an electrical impulse signal that is then fed to the solenoid coil 64 at the desired time. This voltage signal will cause the armature 58 to move rightwardly towards the end of the stand pipe 62 to throttle the communication of return fuel from the inlet 50 through standpipe 62. When the pressure of the fuel return acting on diaphragm 60 equals the force of the armature pushing the valve element 70 in the opposite direction, then an equilibrium position will be obtained and the fuel pressure in line 50 will remain at that level. The pressure force will always be equal to the magnetic force of the solenoid, and since the magnetic force is a function of the current in the solenoid coil, varying the voltage applied to the solenoid coil will, therefore, vary the pressure of the return fuel upstream of the pressure regulator unit 52. As will be understood shortly, varying the fuel return pressure will vary the stroke of the pumping plungers of the unit fuel injector assemblies 24.

More specifically, FIGS. 2 and 3 show the construction of the unit injector assemblies 24. The lower part of each assembly 24 contains a conventional fuel injector 80 having a fuel pressure actuated valve that opens outwardly when the fuel pressure reaches a sufficient level. The details of construction of this particular injector are not given since they are known and believed to be unnecessary for an understanding of the invention. Suffice it to say that it could be constructed as fully shown and described in U.S. Pat. No. 3,542,293, Bishop et al assigned to the assignee of this invention, with a tension spring unit for maintaining the valve closed below a predetermined fuel pressure.

Fuel injector 82 at its upper end contains a fuel inlet 84 that is connected to the fuel pressure branch supply line 22 shown in FIG. 1. Although not shown, a check valve would be included in the line to permit entry of fuel into inlet 84 but closure of the inlet upon actuation of the pump plunger unit to be described to prevent the return of fuel out of the supply line.

The unit injector 80 is inserted into the lower open end of a second housing 86 that encloses a solenoid coil 88 secured to an annular stationary core element 90. The latter surrounds a reciprocable armature element 92 that is formed integral with a plunger 94 to constitute a fuel pumping unit. The upper end of the pump plunger 94 is, as seen in FIG. 3, of a forked shape to provide a yoke 96 that receives therein the cylindrical portion of a stroke control rod 98. The plunger-armature 92 also is formed with a flange 100 that constitutes a seat for a spring 102 that lightly biases the plunger-armature upwardly into engagement with the bottom surface of control rod 98.

The control rod 98 in this case determines the stroke of the plunger 92 and therefore controls the volume of fuel injected through the unit injector 80 at any particular time. The control rod 98 is slideably movable essentially at right angles to the axis of plunger 72, and moves in a housing 104. It is tapered longitudinally, as shown, providing a conical surface 99. The control rod is moveable axially to vary the point of engagement with the fork or yoke 96 of the pump plunger to thereby vary the distance the plunger can travel upwardly on its fuel intake stroke.

The leftward (as seen in FIG. 2) end of control rod 98 is fixed to an annular flexible diaphragm 106 by means of a pair of nut like members 108. The diaphragm partitions a housing cap 110 into an atmospheric air chamber 112 and a fuel pressure chamber 114. Chamber 112 is connected to atmosphere through a vent hole 116, while chamber 114 is connected to the fuel in the pump plunger housing through a port 118 connected to the upper chamber 120 containing fuel leaking between the armature and the stationary core of the solenoid. The fuel in chamber 120 passes out to a drain or return line 26 through an annulus 122 connected to an axial passage 124 in the control rod 98 open at its end to the return passage. Opposite ends of the control rod are formed with hex-head sockets 126 and 128 for insertion of a Allen-head type wrench to adjust the axial portion of the control rod relative to the nut like retaining members 108. The purpose of this is to permit initial calibration of all unit injector assemblies for identical fuel delivery of the same reference return fuel pressure level. It will be clear that a change in the pressure level of the return fuel in line 26 will be reflected against the right side of the diaphragm 106 to oppose the force of the atmospheric pressure in chamber 112 and the force of a spring 127 biasing the control rod 98 to the right, to vary the position of the control rod with reference to the fork or yoke 96 of the pump plunger. Accordingly, the travel distance during the intake stroke of plunger 94 will be varied, thereby controlling the amount of fuel intake and controlling the volume of fuel ultimately injected during the pumping stroke.

While not shown, the solenoid coil 88 would be connected electrically to the engine microprocessor or other suitable control element 74 for energization at the desired time to move the pump plunger or armature 94 downwardly to pressurize the fuel in the unit injector 80. The fuel fills the injector volume underneath the plunger 94 and, therefore, is compressed during downward movement of the plunger to a level above the opening pressure level of the injector, whereby the volume of fuel desired is injected into the engine combustion chamber proper. The timing of the injection will be controlled by the timing of the solenoid pulses as a function of engine speed, load and other parameters. The amount of fuel injected, as stated previously, is determined by the plunger stroke, which can be varied by varying the upper starting position of the plunger 94 while its lower position stop remains fixed.

From the above description, it will be seen that the unit injector assembly of the invention provides a precise control of the injection of a small quantity of fuel over a predetermined period, which is quite suitable as the fuel supply for a prechamber type combustion chamber. Of course, a system similar to the one described can also be used for control of the fuel to the main combustion chamber. The basic difference in this particular case would be the larger amounts of fuel that are needed for a main combustion chamber and a greater accuracy of fuel delivery control to assure the proper air to fuel ratio control. The larger amounts of fuel injected can be handled by increasing the diameter and the stroke of the plunger 94, and the use of a more powerful solenoid. The accuracy of this system can be improved by using a closed loop control electronic system, as compared with an open loop system normally used for the system already described.

Figure 5:
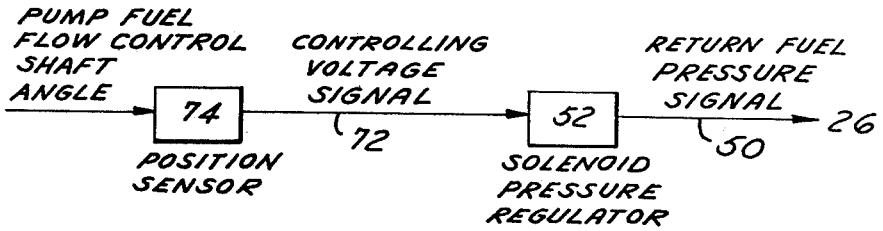
FIGS. 5 and 6 are schematic block diagram representations of controls for various elements of the system shown in FIG. 1 to control operation of the same.
Figure 6:
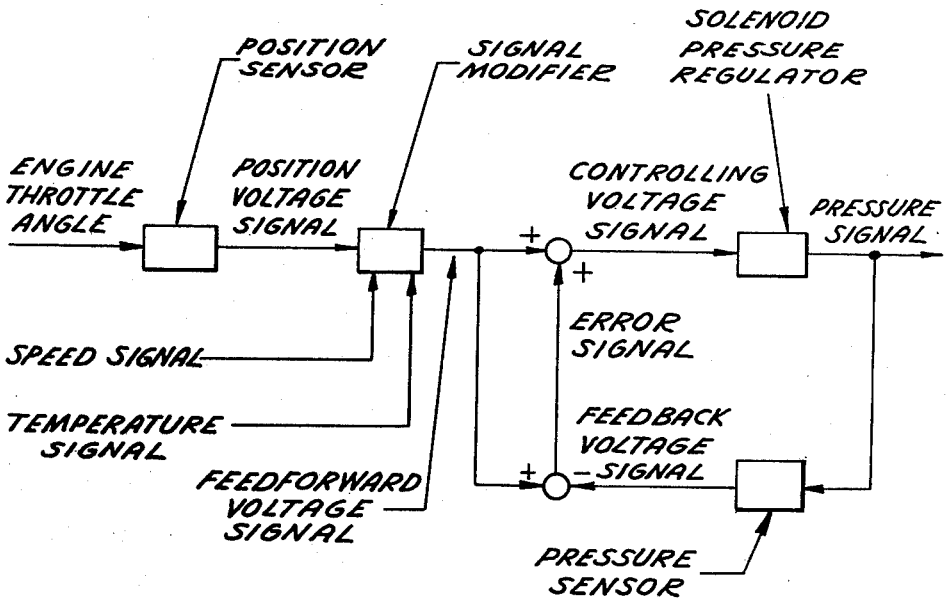

More particularly, FIGS. 5 and 6 illustrate examples of open and closed loop control systems, respectively. FIG. 5 is a block diagram of the open loop control system for specific use with a torch ignition or prechamber type engine construction. FIG. 1 illustrates the fuel supply branch line 20 as being connected to a main fuel injection pump that supplies fuel to the main combustion chamber. This pump could be as fully shown and described in U.S. Pat. No. 4,197,059, Simko, assigned to the assignee of this invention. It shows a fuel pump flow control lever 180 whose rotational position indicates the quantity of fuel flowing from the pump. The block diagram of FIG. 5 in this application indicates an input from the pump control shaft of the main fuel injection pump (such as is shown in Simko) connected to a position sensor that develops a controlling voltage signal representing the control shaft angle, which is then converted into a fuel pressure signal by the solenoid controlled pressure regulator 52 shown in FIG. 1 to thereby control the level of the return fuel pressure signal in line 26 connected to each of the fuel injection unit assemblies 24.

FIG. 6 shows a block diagram of the closed loop control system that could be used for controlling the injection of fuel into a main combustion chamber type of construction. In this case, the angle of the throttle valve located in the air induction pipe leading to the engine combustion chamber is sensed by the position sensor indicated, which converts the same into a voltage signal that, in this case, would be modified in accordance with the speed and temperature of the engine, for example, to produce a signal that is shaped for proper relationship of the torque and throttle angle. The resulting feedforward voltage signal represents the required schedule of the fuel pressure signal in return line 26 that controls the fuel delivery stroke in all unit injector assemblies 24. In this case, a pressure sensor is installed in the return fuel line to generate a feedback voltage signal that is compared to the feedforward voltage signal, as indicated. The resulting error signal is then added to the feedforward signal, modifying it into a controlling voltage signal applied to the terminals of the solenoid pressure regulator 52. So long as the pressure signal corresponds to the required schedule, the feedback and feedforward voltage signals would be equal, and the error signal zero; the controlling voltage signal, therefore, is equal to the feedforward signal. Any deviation from the required value of the pressure signal would then produce a positive or negative error signal which would modify the controlling voltage signal to minimize the deviation.

The operation is believed to be clear from the above description and a consideration of the drawings and therefore will not be given in detail. Suffice it to say that the supply pump 10 always supplies an excess of fuel through the system and through the pressure regulator valve unit 30 so as to provide a return fuel flow in line 46 and in the return lines 26 to the pressure regulator unit 52. The unit injector assemblies are filled with fuel supplied through the inlet 84 at a low pressure level. Energization of the solenoid 88 causes the plunger 94 to move downwardly to compress the fuel in the injector 80 and open the same to inject fuel out into the engine proper. The stroke or volume of fuel injected is determined by the axial position of the control rod 98 to vary the location of the conical surface of the rod with respect to the fork or yoke 96 to limit the upper or intake stroke of the plunger. The variance of the return fuel pressure in line 26 will determine the position of the control rod and will, therefore, determine the volume of fuel injected. In turn, the signal from the microprocessor unit 74 to the solenoid controlled pressure regulator 52 will vary the backpressure or return pressure in line 26 to thereby vary the stroke control in accordance with the demand of the engine.

While the invention has been shown and described in its preferred embodiments, it will be clear to those skilled in the arts to which it pertains that many changes and modifications may be made thereto without departing from the scope of the invention.

What is claimed is:

1. A fuel injection and control system for an automotive type internal combustion engine of the spark ignition type, including a fuel injector assembly including a fuel injector of the spring closed, fuel pressure opened type, a plunger type electromagnetically operated fuel pump having a plunger movable through a pumping stroke upon energization of the electromagnetic means to increase the fuel pressure to a level sufficient to open the injector and through a fuel intake stroke upon deenergization of the electromagnetic means, and a fluid pressure actuated fuel pump stroke control connected to the plunger and movable to limit the stroke of the plunger as a function of changes in the fluid pressure to thereby vary the volume of fuel and timing of fuel injected through the injector, a source of fuel at a low supply pressure connected to the assembly supplying fuel to the plunger during the intake stroke thereof, a fuel flow return line for containing fuel leakage past the plunger, means applying the return fuel to the stroke control for actuating the control to various positions as a function of changes in the return fuel pressure, and an engine responsive electromagnetically controlled fuel pressure regulator connected to the return line for varying the return fuel pressure as a function of changes in engine operation to thereby vary the stroke of the pump plunger.

2. A system as in claim 1, including a second fuel pressure regulator in the return line operable to establish the low supply pressure and maintain a lower minimum level fuel return pressure, the first mentioned pressure regulator including a solenoid type valve movable upon energization of the solenoid to restrict the return fuel line and thereby vary the return fuel pressure upstream thereof at the stroke control means, and means responsive to changing engine operation to vary the voltage to the solenoid to vary the return fuel pressure to levels above the minimum.

3. A system as in claim 1, the stroke control including means variably movable into the path of movement of the plunger to variably restrict the travel of the plunger.

4. A fuel injection system for an automotive type internal combustion engine comprising, a plunger type fuel pump having a fuel inlet connected to a low pressure supply source of fuel and having a fuel discharge line connected to a fuel injector of the spring closed fuel pressure opened type, a variable pressure return line connected to a low pressure fuel supply tank at all times and containing fuel leakage from the pump, a movable plunger stroke control means actuated by the pressure of fuel in the return line to adjust the stroke of the plunger, and a solenoid controlled fuel pressure regulator in the return line responsive to changing engine conditions to vary the return line pressure to a level between the supply pump and fuel discharge pressure levels and thereby vary the stroke of the plunger to vary the volume discharge of fuel through the injector.

5. A system as in claim 4, including engine responsive means connected to the solenoid for varying the voltage thereto in response to changing engine operating conditions to vary the return line pressure and thereby vary the discharge volume of fuel through the injectors.

6. A system as in claim 4, including a plurality of pumps corresponding in number to the number of cylinders of the engine and a plurality of injectors each connected individually to the discharge line of one of the pumps, and a separate stroke control means connected to each of the pumps and all connected to the return line.

7. A system as in claim 4, the pump constituting a portion of a fuel injector assembly consisting of a fuel injector, the plunger type pump, and the stroke control means all integrated together as a unit, and a number of units with a separate unit for each cylinder of the engine, all of the units being controlled simultaneously by the return line pressure level.

8. A system as in claim 4, the pressure regulator including a housing having a diaphragm type valve connected to the armature of the solenoid for movement therewith, a standpipe vented at one end and open at the other end to return line fuel and variably blockable at the other end of the valve to increase the backpressure in the return line, and position sensing means connected to predetermined engine parts and to the solenoid for varying the voltage to the solenoid upon changes in position of the sensor to thereby vary the backpressure in the return line and change the stroke of the plunger.

9. A system as in claim 8, the pump constituting a portion of a fuel injection assembly consisting of a fuel injector, the plunger type pump and the stroke control means all integrated together as a unit, and a number of units with a separate unit for each cylinder of the engine, all of the units being controlled simultaneously by the return line pressure level.

* * * * *